US008376568B2

(12) United States Patent
Kim

(10) Patent No.: US 8,376,568 B2
(45) Date of Patent: Feb. 19, 2013

(54) RECHARGEABLE FLASHLIGHT ELECTRICALLY CHARGED BY A CIGAR JACK

(75) Inventor: Seon-Soo Kim, Busan (KR)

(73) Assignee: Aitec Co., Ltd., Busan (KR)

( * ) Notice: Subject to any disclaimer, the term of this patent is extended or adjusted under 35 U.S.C. 154(b) by 404 days.

(21) Appl. No.: 12/825,465

(22) Filed: Jun. 29, 2010

(65) Prior Publication Data

US 2011/0157877 A1 Jun. 30, 2011

(30) Foreign Application Priority Data

Dec. 28, 2009 (CN) ..... 2009 2 0297909

(51) Int. Cl.
*F21L 4/00* (2006.01)
*F21L 13/00* (2006.01)

(52) U.S. Cl. ..... 362/183; 362/205

(58) Field of Classification Search ..... 362/183–208, 362/253

See application file for complete search history.

(56) References Cited

FOREIGN PATENT DOCUMENTS

KR 10-2001-00994887 11/2001
KR 20-0277986 6/2002
KR 10-2008-0007534 1/2008

*Primary Examiner* — Jason Moon Han
(74) *Attorney, Agent, or Firm* — Harness, Dickey & Pierce, P.L.C.

(57) ABSTRACT

A rechargeable flashlight electrically charged by a cigar jack includes a body unit and a head unit. The body unit includes a charging terminal connected to an external power of a car by a cigar jack, a rechargeable battery connected to the charging terminal and charged by the cigar jack, and a contact pin connected to the charging terminal and an electrode of the rechargeable battery. The head unit includes a circuit board having a circuit pattern contacting the contact pin and a light source connected to the circuit pattern and irradiating a light, and rotatablely couples on a front end of the body unit. The circuit pattern selectively contacts with the contact pin according to the rotation of the head unit so that the rechargeable battery is charged, and the light source is turned on or turned off.

7 Claims, 8 Drawing Sheets

RECHARGEABLE FLASHLIGHT ELECTRICALLY CHARGED BY A CIGAR JACK

CROSS-REFERENCE TO RELATED APPLICATIONS

This application claims the benefit of China Patent Application No. 200920297909.2, filed on Dec. 28, 2009, in the China Patent Office, the disclosure of which is incorporated herein in its entirety by reference.

BACKGROUND

1. Field

Example embodiments relate to a rechargeable flashlight, and more particularly, to a rechargeable flashlight electrically charged by a cigar jack of a car.

2. Description of the Related Art

A flashlight is generally turned on or off by using a dry cell as a power source, and thus the flashlight is usually difficult to be manufactured to a size smaller than that of the dry cell. For that reason, the size of the flashlight is decisively determined by the size of the dry cell. A tiny button battery has been used for the flashlight for downsizing the flashlight. However, the capacity of the button battery is so small that the battery life is very short, particularly, for about 1-2 hours, and thus the button battery is required to be frequently exchanged for the flashlight. In addition, there are also problems in that the tiny button battery is relatively expensive in view of the capacity and causes various environmental pollutions due to mercury included therein.

Various rechargeable flashlights, particularly charged by a cigar jack of a car (hereinafter, referred to as cigar flashlight), have been suggested for solving the frequent battery exchange problem, as disclosed in Korea patent Laid-open Publication No. 2001-0099487 entitled "Multipurpose cigar flashlight including multi jack", Korea Utility Model No. 277986 entitled "Multipurpose cigar flashlight interface including USB port and multi jack for automobile" and Korea patent Laid-open Publication No. 2008-0007534 entitled "Multipurpose mobile cigar adaptor including chiller and warmer."

However, the above conventional cigar flashlights have various functions caused by a car cigar jack such as emergency blinks or calls and a power source for a cellular phone or a laptop computer, and thus various components or parts need to be assembled to the conventional cigar flashlights. As a result, the conventional cigar flashlight becomes very expensive and is relatively large.

Therefore, there has been still a need for an improved cigar flashlight which is sufficiently downsized, inexpensive and convenient for use.

SUMMARY

Example embodiments provide a rechargeable flashlight electrically charged by a cigar jack that is inexpensive and sufficiently small and portable.

Other example embodiments provide a rechargeable flashlight electrically charged by a cigar jack having a rotary switching structure without an additional switch to thereby reduce manufacturing cost.

According to some example embodiments, there is provided a rechargeable flashlight using a cigar jack comprising a body unit and a head unit. The body unit includes a charging terminal connected to a charging power which is placed in a cigar jack of a car, a rechargeable battery connected to the charging terminal and charged by the charging power, and a contact pin connected to the charging terminal and an electrode of the rechargeable battery. The head unit includes a circuit board having a circuit pattern contacting the contact pin and a light source connected to the circuit pattern and irradiating a light, and rotatablely couples on a front end of the body unit. The circuit pattern selectively contacts the contact pin according to the rotation of the head unit so that the rechargeable battery is charged, and the light source is turned on or turned off.

In some example embodiments, the charging terminal may include a minus charging terminal placed on a side of the body unit and contacting a minus electrode of the cigar jack, and a plus charging terminal placed on a rear side of the body unit and contacting a plus electrode of the cigar jack.

In some example embodiments, the contact pin may include a first pin electrically connected to a minus electrode of the rechargeable battery, a second pin electrically connected to the minus charging terminal, and a third pin electrically connected to the plus charging terminal and a plus electrode of the rechargeable battery, and the circuit pattern may include a first and a third circuit patterns connected to the light source and a second and a fourth circuit patterns electrically connected each other.

In some example embodiments, the second pin and the second circuit pattern may maintain a contact state, wherein when the first pin contacts the first circuit pattern and the third pin contacts the third circuit pattern according to the rotation of the head unit, the light source may be turned on, when the first pin and the third pin do not contact the first to the fourth circuit patterns according to the rotation of the head unit, the light source may be turned off, and when the first pin contacts the fourth circuit pattern and the third pin does not contact the first to the fourth circuit patterns according to the rotation of the head unit, the rechargeable battery may be charged.

In some example embodiments, the body unit may further include a inner barrel having a guide hole at a front end portion of the inner barrel, the head unit may further include a connecting member having a protrusion for inserting on the guide hole at a rear end portion of the connecting member, and when the head unit rotates, the protrusion may be travel along the guide hole.

According to some example embodiments, there is provided a rechargeable flashlight using a cigar jack comprising a body unit and a head unit rotatablely coupling on a front end of the body unit, and wherein the flashlight is charged by a cigar jack of a car. The body unit includes a minus charging terminal contacting a minus electrode of the cigar jack, a plus charging terminal contacting a plus electrode of the cigar jack, a rechargeable battery charged by the minus and the plus charging terminals, and a contact pin having a first pin electrically connected to a minus electrode of the rechargeable battery, a second pin electrically connected to the minus charging terminal, and a third pin electrically connected to the plus charging terminal and a plus electrode of the rechargeable battery. The head unit includes a circuit board having a first to a fourth circuit patterns selectively contacting the contact pin according to the rotation of the head unit, and wherein the second and the fourth circuit patterns electrically connected each other, and a light source connected to the first and the third circuit patterns and irradiating a light. The first to the fourth circuit patterns selectively contact the contact pin according to the rotation of the head unit so that the rechargeable battery is charged, and the light source is turned on or turned off.

In some example embodiments, the body unit may further include a inner barrel having a guide hole at a front end portion of the inner barrel, the head unit may further include a connecting member having a protrusion for inserting on the guide hole at a rear end portion of the connecting member, and when the head unit rotates, the protrusion may be travel along the guide hole.

According to some example embodiments of the present inventive concept, a flashlight is frequently charged using a cigar jack of a car, so that the flashlight may be used without a discharge of a rechargeable battery.

In the flashlight, a turn on and a turn off a light source and a charging a rechargeable battery may be selected according to a rotation of a head unit on a body unit. Thus, the flashlight may have a small size and a strong structure because a switch structure does not project from a surface of the flashlight.

BRIEF DESCRIPTION OF THE DRAWINGS

Example embodiments will be more clearly understood from the following detailed description taken in conjunction with the accompanying drawings.

DETAILED DESCRIPTION OF THE EMBODIMENTS

Figure 1:
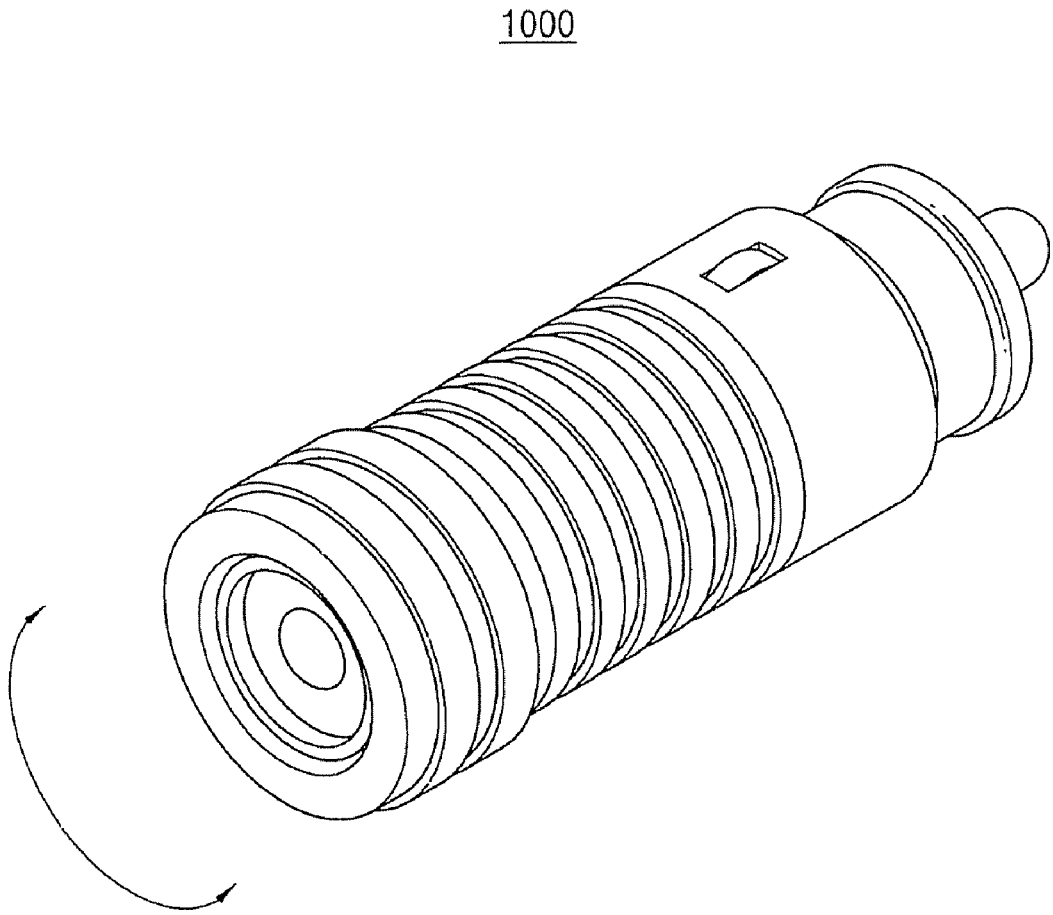
FIG. 1 is a perspective view illustrating a rechargeable flashlight in accordance with a first example embodiment of the present inventive concept.

Various example embodiments will be described more fully hereinafter with reference to the accompanying drawings, in which some example embodiments are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below"' or "beneath" other elements or features would then be oriented "above" the other elements or features. Thus, the exemplary tem.("below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, example embodiments will be explained in detail with reference to the accompanying drawings.

Figure 2:
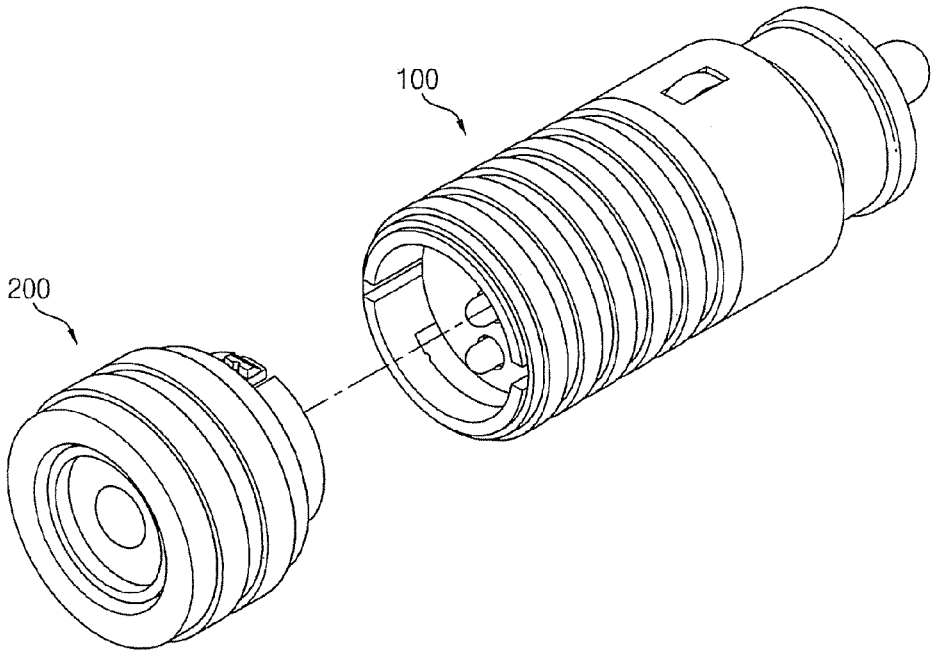
FIG. 2 is a perspective view illustrating a head unit and a body unit of the flashlight shown in FIG. 1.
Figure 3:
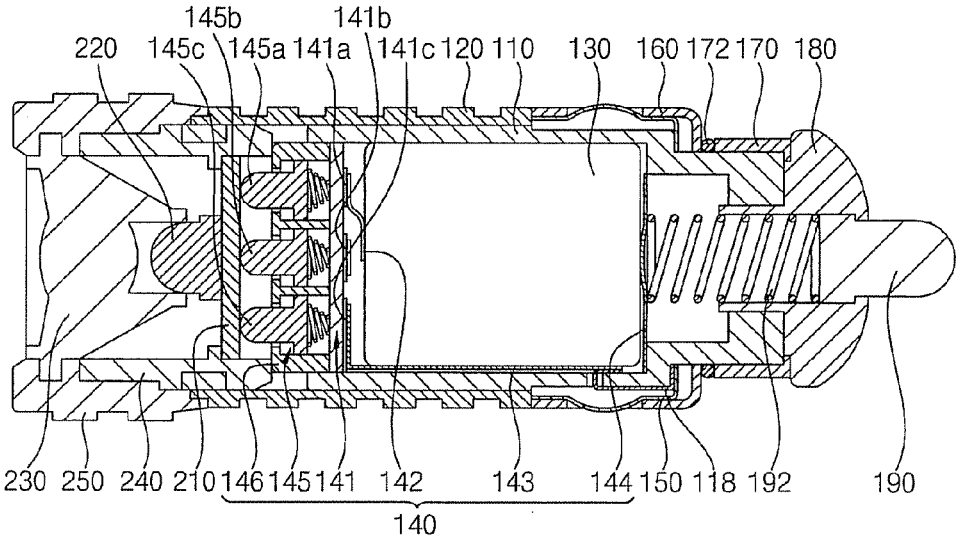
FIG. 3 is a cross-sectional view illustrating the flashlight shown in FIG. 1.
Figure 4:
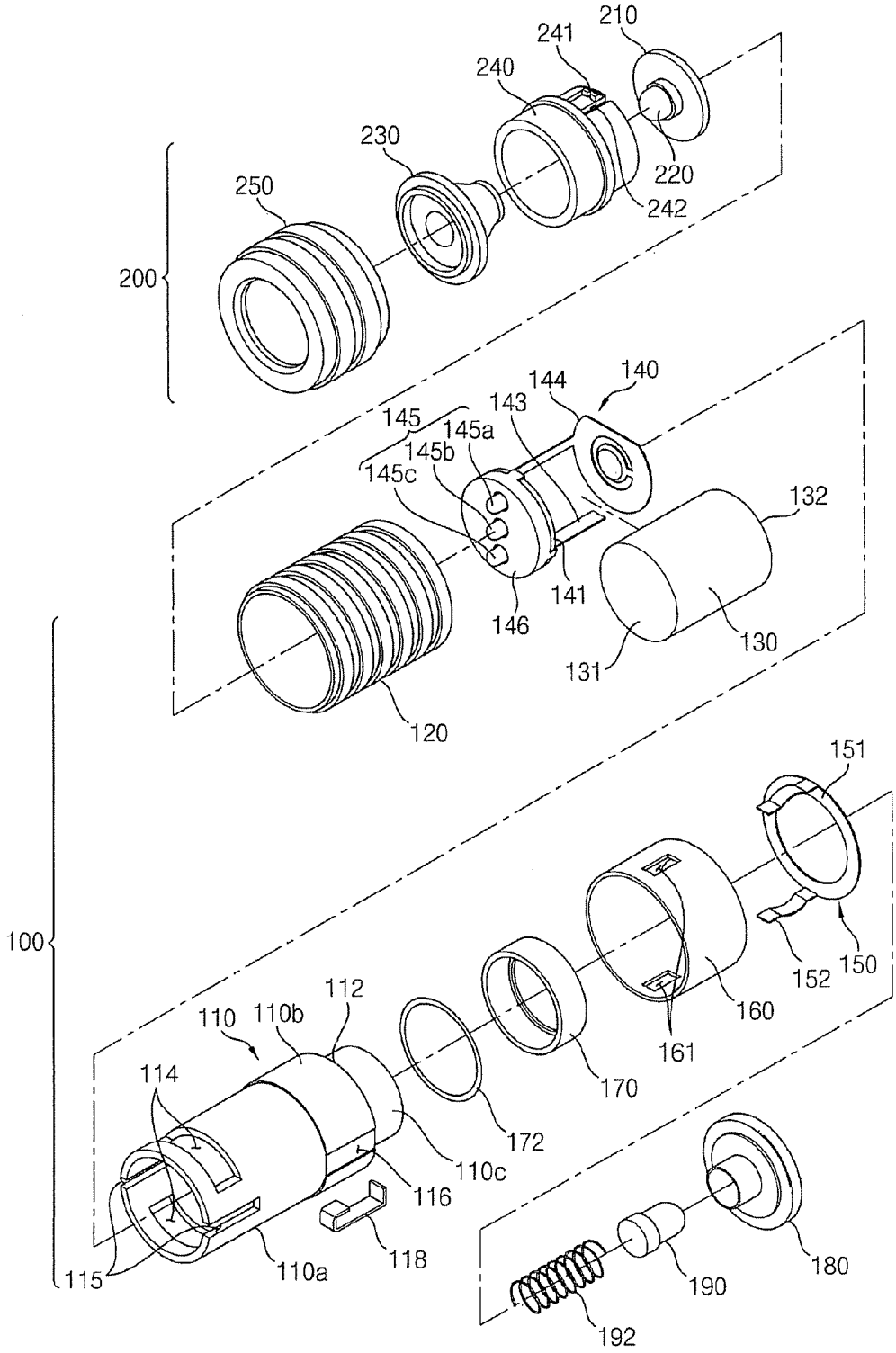
FIG. 4 is an exploded perspective view illustrating the flashlight shown in FIG. 1.
Figure 5:
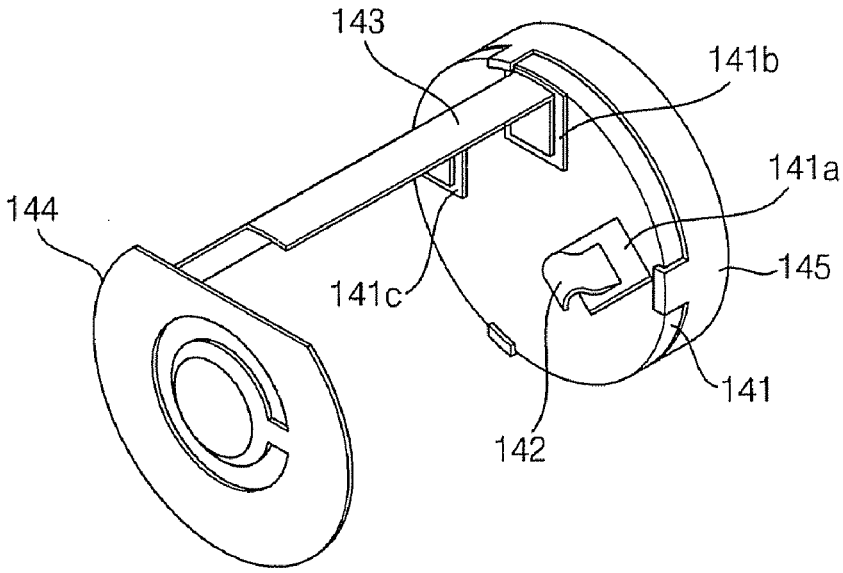
FIG. 5 is a perspective view illustrating a rechargeable holder shown in FIG. 4.
Figure 6:
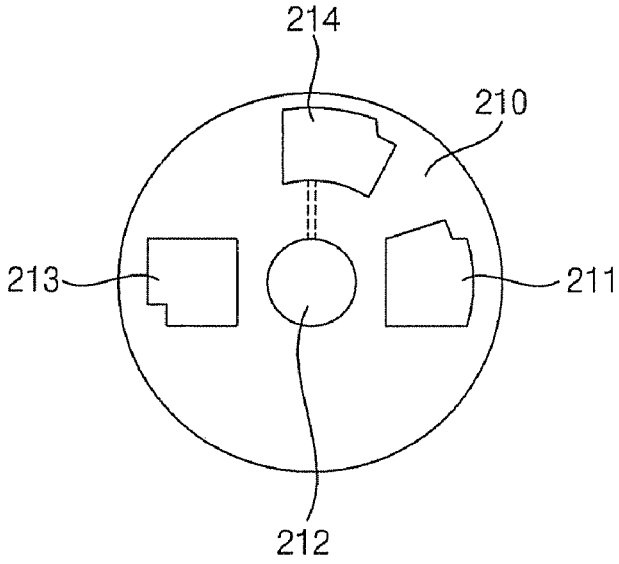
FIG. 6 is a bottom view illustrating a circuit board shown in FIG. 4.

FIG. 1 is a perspective view illustrating a rechargeable flashlight in accordance with a first example embodiment of the present inventive concept. FIG. 2 is a perspective view illustrating a head unit and a body unit of the flashlight shown in FIG. 1 and FIG. 3 is a cross-sectional view illustrating the flashlight shown in FIG. 1. FIG. 4 is an exploded perspective view illustrating the flashlight shown in FIG. 1 and FIG. 5 is a perspective view illustrating a rechargeable holder shown in FIG. 4.

Referring to FIGS. 1 to 5, a rechargeable flashlight 1000, which is charged using a cigar jack of a car, may include a body unit 100 inserted in the cigar jack and a head unit 200 connected to the body unit 100.

The body unit 100 may include an inner barrel 110, an outer barrel 120, a rechargeable battery 130, a battery holder 140, a minus charging terminal 150, a fixing ring 160, a protecting ring 170, an insulating ring 172, a rear end cap 180, a plus charging terminal 190, and a spring 192.

The inner barrel 110 may have a hollow cylindrical shape including an open top and bottom. The inner barrel 110 may comprise insulating material.

The inner barrel 110 may include a front portion 110*a*, middle portion 110*b*, and a rear portion 110*c*.

An internal diameter of the front portion 110*a* is substantially the same as that of the middle portion 110*b*. An internal diameter of the rear portion 110*c* is smaller than those of the front portion 110*a* and the middle portion 110*b*. An external diameter of the middle portion 110*b* is a little greater than that of the front portion 110*a*. An external diameter of the rear portion 110*c* is smaller than that of the front portion 110*a*. Thus, a step 112 may be placed between the middle portion 110*b* and the rear portion 110*c*.

The inner barrel 110 may have a pair of guide holes 114 and a pair of first elastic slots 115 at the front portion 110*a*. The guide holes 114 are located along a circumference of front portion 110*a* and faced each other. The first elastic slots 115 may extend from an end portion of the front portion 110*a* along a central axis of the inner barrel 110 and may be arranged on the circumference of the front portion 110*a* alternately with the guide holes 114 in a circumferential direction. Therefore, the front portion 110*a* may have elasticity due to the guide holes 114.

The inner barrel 110 may have a pair of guide recesses 116 on the middle portion 110*b*. The guide recesses 116 may extend along the central axis of the inner barrel 110. In an example embodiment, the guide recesses 116 may be placed correspondently to the first elastic slots 115.

The inner barrel 110 may further include a conductive piece 118. The conductive piece may penetrate through the middle portion 110*b* and electrically connect an outside of the step 112 of the inner barrel 110 and an inside of the middle portion 110*b*.

The outer barrel 120 may have a hollow cylindrical shape with an open top and bottom. The outer barrel 120 may be inserted in the front portion 110*a* of the inner barrel 110. The outer barrel 120 protects the inner barrel 110. The outer barrel 120 may comprise metal. The outer barrel 120 may have a knurling surface for preventing slip.

The rechargeable battery 130 may function as a power source for the flashlight 1000. The rechargeable battery 130 may be charged by the cigar jack.

The battery holder 140 for supporting the rechargeable battery 130 may include a terminal board 141, a first conductive plate 142, a second conductive plate 143, a third conductive plate 144, an elastic contact pin 145 and a fixing cap 146.

The terminal board 141 may be positioned on a front end of the rechargeable battery 130. A first terminal 141*a*, a second terminal 141*b*, and a third terminal 141*c* may be arranged on a rear surface of the terminal board 141.

The first conductive plate 142 has a front end fixed on the first terminal 141*a* and a rear end contacting a minus electrode 131 of the rechargeable battery 130.

The second conductive plate 143 has a front end fixed on the second terminal 141*b* and a rear end extending to a side of the rechargeable battery 130.

The third conductive plate 144 has a front end fixed on the third terminal 141*c* and a rear end contacting a plus electrode 132 of the rechargeable battery 130.

The elastic contact pin 145 may include a first pin 145*a*, a second pin 145*b*, a third pin 145*c*, and three springs. The first pin 145*a*, the second pin 145*b* and the third pin 145*c* are arranged in a line, and the springs are positioned between the first to the third pins 145*a*, 145*b* and 145*c* and a front face of the terminal board 141, respectively. The first pin 145*a* is connected to the first terminal 141*a* through a medium of the spring, the second pin 145*b* is connected to the second terminal 141*b* through a medium of the spring, and third pin 145*c* is connected to the third terminal 141*c* through a medium of the spring. Therefore, the first pin 145*a* is electrically connected to the minus electrode 131 of the rechargeable battery 130, the second pin 145*b* is electrically connected to a minus charging terminal of the cigar jack, and the third pin 145*c* is electrically connected to the plus electrode 132 of the rechargeable battery 130 and a minus charging terminal of the cigar jack.

The fixing cap 146 is connected to the terminal board 141 so as to fix the first pin 145*a*, the second pin 145*b*, the third pin 145*c*, and the three springs. Front ends of the first pin 145*a*, the second pin 145*b*, and the third pin 145*c* are projected from the fixing cap 146.

The battery holder 140 to which the rechargeable battery 130 may be hold may be inserted into the inner barrel 110 through a front end of the inner barrel 110. The rechargeable battery 130 and the battery holder 140 may be arranged in the inner barrel 110 and supported by the step 112 of the inner barrel 110. The second conductive plate 143 of the battery holder 140 contacts the conductive piece of the inner barrel 110.

The minus charging terminal 150 may be connected to the minus electrode of the cigar jack. The minus charging terminal 150 may include a ring portion 151 having a ring shape and a pair of elastic portions 152 extending from both ends of the ring portion 151. The minus charging terminal 150 may be inserted in the rear portion 110*c* of the inner barrel 110. The ring portion 151 is supported by the step 112 of the inner barrel 110. The elastic portions 152 are inserted in the guide recesses 116 of the inner barrel 110, respectively. The ring portion 151 contacts the conductive piece of the inner barrel 110 so that the minus charging terminal 150 may be electrically connected to the second conductive plate 143 through the conductive piece.

The fixing ring 160 is inserted from a rear end of the inner barrel 110 so as to fix to the middle portion 110*b* of the inner barrel 110. The fixing ring 160 fixes the minus charging terminal 150 to the inner barrel 110. The fixing ring 160 may have a pair of through holes 161. The elastic portions 152 of the minus charging terminal 150 may be protruded through the through holes 161, respectively. The fixing ring 160 may comprise metal.

The protecting ring is inserted from the rear end of the inner barrel 110 so as to fix to the rear portion 110*c* of the inner barrel 110. The protecting ring 170 protects the rear portion 110*c* of the inner barrel 110. The protecting ring 170 may comprise metal.

The insulating ring 172 may be disposed between the fixing ring 160 and the protecting ring 170. The insulating ring 172 insulates the fixing ring 160 and the protecting ring 170. The insulating ring 172 may comprise insulating material such as rubber.

The rear end cap 180 may be coupled to the rear portion 110*c* of the inner barrel 110.

The plus charging terminal 190 is inserted from a front end of the rear end cap 180 so as to protrude from a rear end of the rear end cap 180. The plus charging terminal 190 contacts with the plus electrode of the cigar jack.

The spring 192 is positioned between the plus charging terminal 190 and the battery holder 140. The spring 192 may apply an elastic force to the plus charging terminal 190. Therefore, the plus charging terminal 190 may make elastic contact with the plus electrode of the cigar jack.

In addition, the plus charging terminal 190 and the third conductive plate 144 of the battery holder 140 may be electrically connected to each other by the spring 192. The third conductive plate 144 contacts with the plus electrode 132 of the battery 130 so that the plus charging terminal 190 also contacts the plus electrode 132 of the battery 130.

The head unit 200 may be coupled to the front end of the body unit 100. The head unit 200 may include a circuit board 210, a light source 220, a lens 230, a connecting member 240, and a front end cap 250.

The circuit board 210 may have a circular plate shape, and include a first circuit pattern 211, a second circuit pattern 212, a third circuit pattern 213, and a fourth circuit pattern 215.

The second circuit pattern 212 is arranged on a center portion of a rear face of the circuit board 210, and the first circuit pattern 211 and the third circuit pattern 213 are opposite to each other on the second circuit pattern 212. That is, the first circuit pattern 211, the second circuit pattern 212, and the third circuit pattern 213 are disposed in a line on the rear face of the circuit board 210. The fourth circuit pattern 214 is spaced apart from the second circuit pattern 212 on the rear face of the circuit board 210. The second circuit pattern 212 and the fourth circuit pattern 214 are electrically connected each other using a wire (not shown).

The light source 220 may be fixed to a front face of the circuit board 210. The light source 220 is electrically connected to the first circuit pattern 211 and the third circuit pattern 213 using wires (not shown). For example, the light source 220 may include a light emitting diode.

The lens 230 may have receiving recess (not shown) for receiving the light source 220 and concentrate a light irradiated from the light source 220.

The connecting member 240 may have a hollow cylindrical shape with an open top and bottom. The circuit board 210 onto which the light source 220 is fixed is inserted from a rear end of the connecting member 240 and the lens 230 is inserted from a front end of the connecting member 240.

A pair of protrusions 241 may be arranged on a rear end of an outer surface of the connecting member 240. The protrusions 241 are opposite to each other. Further, the connecting member 240 has second elastic slots 242. The second elastic slots 242 are placed on both sides of the protrusion 241, respectively, and extend from the rear end to the front end of the connecting member 240. Thus, the rear end of the connecting member 240 having the protrusions 241 may have elasticity.

The connecting member 240 is connected to the inner barrel 110. In an example embodiment, the protrusions 241 of the connecting member 240 may be inserted into the guide holes 114 of the inner barrel 110. The rear end of the connecting member 240 having the protrusions 241 and the front end of the inner barrel 110 having the guide holes 114 have elasticity, so that the connecting member 240 and the inner barrel 110 may be easily connected with each other. The rear face of the circuit board 210 may contact with the elastic pin 145 of the battery holder 140.

As the protrusions 241 move along the guide holes 114, the connecting member 240 may rotate on the inner barrel 110 by a predetermined angle. A contacting portion of the circuit board 210 and the elastic contact pin 145 may become different from each other according to the rotation of the connecting member 240.

The front end cap 250 may have a hollow cylindrical shape having an open top and bottom. The front end cap 250 is inserted into the front end of the connecting member 240. The front end cap 250 may protect the connecting member 240 from surroundings.

Figure 7:
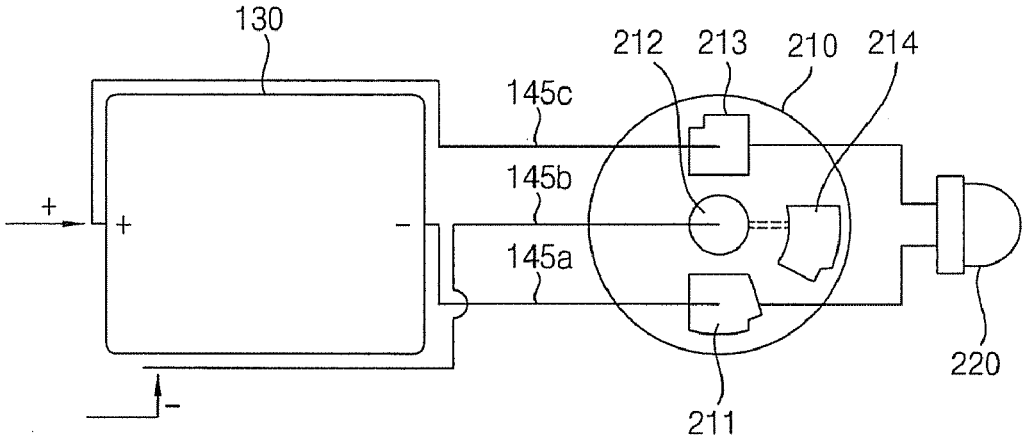
FIGS. 7 to 9 are views illustrating contact of a elastic contact pin of a battery holder and a circuit board shown in FIG. 4.
Figure 8:
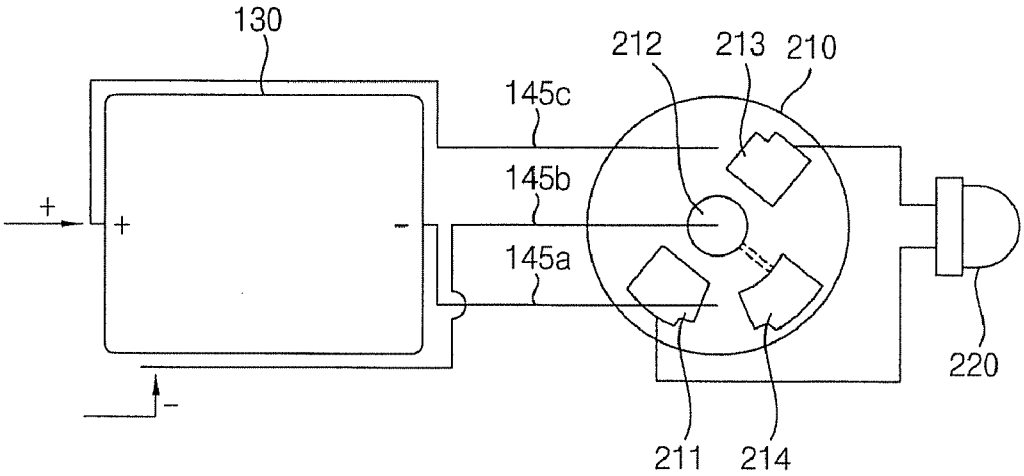
Figure 9:
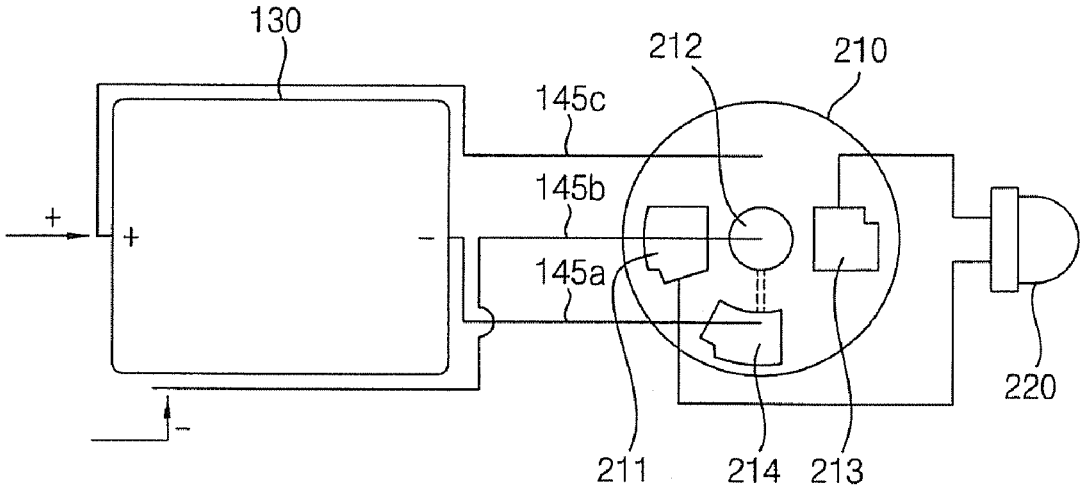

FIGS. 7 to 9 are views illustrating contact of an elastic contact pin of the battery holder and the circuit board shown in FIG. 4.

Referring to FIG. 7, the first pin 145*a* contacts the first circuit pattern 211, the second pin 145*b* contacts the second circuit pattern 212, and the third pin 145*c* contacts the third circuit pattern 213. The first pin 145*a* is connected to the minus electrode 131 of the rechargeable battery 130, the third pin 145*c* is connected to the plus electrode 132 of the rechargeable battery 130, and the first circuit pattern 211 and the third circuit pattern 213 are connected to the light source 220 so that the light source 220 is turned on.

Referring to FIG. 8, the second pin 145*b* contacts with the second circuit pattern 212 and the first pin 145*a* and the third pin 145*c* does not contact with the first to the fourth circuit patterns 211, 212, 213, and 214. Therefore, the light source 220 is turned off.

Referring to FIG. 9, the first pin 145*a* contacts with the fourth circuit pattern 214, the second pin 145*b* contacts the second circuit pattern 212, and the third pin 145*c* does not contact the first to the fourth circuit patterns 211, 212, 213, and 214. The plus electrode 132 of the rechargeable battery 130 is connected to the plus charging terminal of the cigar jack, and the first pin 145*a* connected to the minus electrode 131 of the rechargeable battery 130 and the second pin 145*b* connected to the minus charging terminal of the cigar jack are electrically connected each other through the second circuit pattern 212 and the fourth circuit pattern 214 so that the rechargeable battery 130 is charged by the cigar jack.

Figure 10:
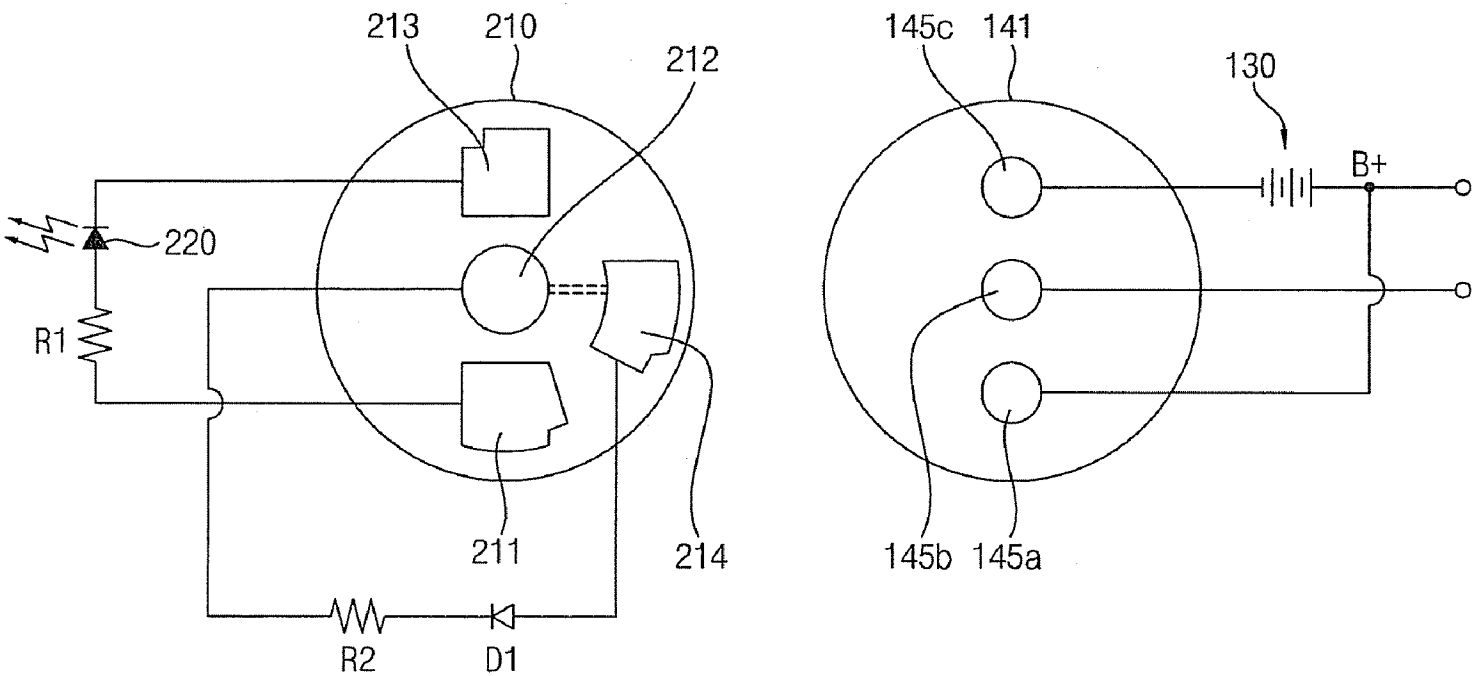
FIG. 10 is a equivalent circuit diagram illustrating the flashlight shown in FIG. 1.

FIG. 10 is an equivalent circuit diagram illustrating the flashlight shown in FIG. 1.

Referring to FIG. 10, a resistance R1 and the light source 220 such as light emitting diode are serially connected with each other between the first circuit pattern 211 and the third circuit pattern 213 of the circuit board 210, and a diode D1 for preventing a reverse current and a resistance R2 are serially connected with each other between the second circuit pattern 212 and the fourth circuit pattern 214 of the circuit board 210.

Figure 11:
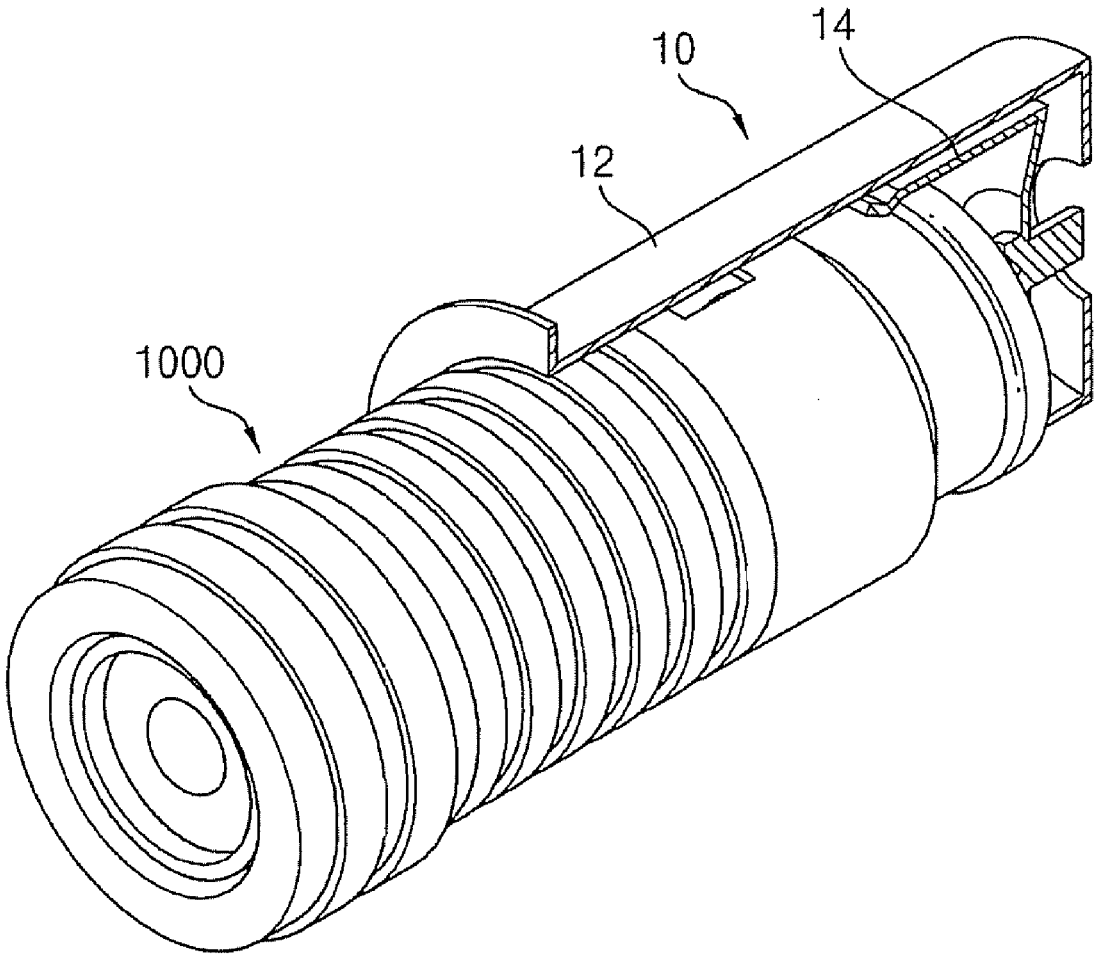
FIG. 11 is a perspective view illustrating the flashlight mounted to a cigar jack shown in FIG. 1.

FIG. 11 is a perspective view illustrating the flashlight mounted to a cigar jack shown in FIG. 1.

Referring to FIG. 11, the cigar jack 10 may include a guide unit 12 and a fixing unit 14.

The guide unit 12 may have a hollow cylindrical shape with an open top and receive the flashlight 1000. The guide unit 12 serves as the minus electrode and contacts the minus charging terminal 150 of the flashlight 1000.

The fixing unit 14 may have a hollow cylindrical shape with an open top and have a size less than that of the guide unit 12. The fixing unit 14 is disposed on an inner bottom of the guide unit 12. The fixing unit 14 fixes the rear end cap 180 of the flashlight 1000. The fixing unit 14 serves as the plus electrode and contacts the plus charging terminal 190 of the flashlight 1000.

Therefore, the flashlight 1000 may be charged by the cigar jack. In the flashlight 1000, the body unit 100 and the head unit 200 is rotatablely connected each other, and turn on and turn off the light source 200 and charging the rechargeable battery 130 may be selected in accordance with the rotation of the head unit 200.

According to the example embodiments of the present inventive concept, the flashlight is charged using the cigar jack so that the flashlight is easily charged and easily used for emergency in a car.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A rechargeable flashlight electrically charged by a cigar jack of a car, comprising:

a body unit including a charging terminal connected to an external power of a car by a cigar jack, a rechargeable battery connected to the charging terminal and charged by the cigar jack, and contact pins connected to the charging terminal and an electrode of the rechargeable battery; and a head unit including a circuit board having a circuit pattern contacting the contact pins and a light source connected to the circuit pattern and irradiating a light, and rotatablely coupling on a front end of the body unit, wherein the circuit pattern selectively contacts the contact pins according to the rotation of the head unit, so that the rechargeable battery is charged and the light source is turned on or turned off.

2. The rechargeable flashlight of claim 1, wherein the charging terminal includes a minus charging terminal placed on a side of the body unit and contacting a minus electrode of the cigar jack, and a plus charging terminal placed on a rear side of the body unit and contacting a plus electrode of the cigar jack.

3. The rechargeable flashlight of claim 2, wherein the contact pins includes a first pin electrically connected to a minus electrode of the rechargeable battery, a second pin electrically connected to the minus charging terminal, and a third pin electrically connected to the plus charging terminal and a plus electrode of the rechargeable battery, and the circuit pattern includes a first and a third circuit patterns connected to the light source and a second and a fourth circuit patterns electrically connected to each other.

4. The rechargeable flashlight of claim 3, wherein the light source is turned on when the first pin contacts the first circuit pattern and the third pin contacts the third circuit pattern according to the rotation of the head unit;

the light source is turned off when the first pin and the third pin do not contact the first to the fourth circuit patterns according to the rotation of the head unit; and the rechargeable battery is charged when the first pin contacts the fourth circuit pattern and the third pin does not contact the first to the fourth circuit patterns according to the rotation of the head unit on condition that the second pin and the second circuit pattern maintain a contact state.

5. The rechargeable flashlight of claim 1, wherein the body unit further includes an inner barrel having a guide hole at a front end portion of the inner barrel, the head unit further includes a connecting member having a protrusion for inserting on the guide hole at a rear end portion of the connecting member, and when the head unit rotates, the protrusion moves along the guide hole.

6. A rechargeable flashlight electrically charged by a cigar jack of a car, comprising:

a body unit; and a head unit rotatablely coupling on a front end of the body unit, and wherein the flashlight is charged by a cigar jack of a car, and wherein the body unit includes a minus charging terminal contacting a minus electrode of the cigar jack, a plus charging terminal contacting a plus electrode of the cigar jack, a rechargeable battery charged by the minus and the plus charging terminals, and contact pins having a first pin electrically connected to a minus electrode of the rechargeable battery, a second pin electrically connected to the minus charging terminal, and a third pin electrically connected to the plus charging terminal and a plus electrode of the rechargeable battery, wherein the head unit includes a circuit board having a first to a fourth circuit patterns selectively contacting the contact pins according to the rotation of the head unit, and wherein the second and the fourth circuit patterns electrically connected each other, and a light source connected to the first and the third circuit patterns and irradiating a light, and wherein the first to the fourth circuit patterns selectively contact the contact pins according to the rotation of the head unit so that the rechargeable battery is charged, and the light source is turned on or turned off.

7. The rechargeable flashlight of claim 6, wherein the body unit further includes an inner barrel having a guide hole at a front end portion of the inner barrel, the head unit further includes a connecting member having a protrusion for inserting on the guide hole at a rear end portion of the connecting member, and when the head unit rotates, the protrusion moves along the guide hole.

* * * * *